US012791184B2

(12) United States Patent
Richmond et al.

(10) Patent No.: US 12,791,184 B2
(45) Date of Patent: Nov. 10, 2026

(54) LOW NOx BURNER WITH TARGETED GAS INJECTION

(71) Applicant: Honeywell International Inc., Charlotte, NC (US)

(72) Inventors: Dusty Ray Richmond, Cleveland, OK (US); Kurt E. Kraus, Tulsa, OK (US); Zhili Qin, Tulsa, OK (US); James W. Harris, Palatine, IL (US); Velmurugan Venkatachalam, Bixby, OK (US); Alexander Green, Palatine, IL (US)

(73) Assignee: Honeywell International Inc., Charlotte, NC (US)

( * ) Notice: Subject to any disclaimer, the term of this patent is extended or adjusted under 35 U.S.C. 154(b) by 353 days.

(21) Appl. No.: 18/476,150

(22) Filed: Sep. 27, 2023

(65) Prior Publication Data

US 2024/0167678 A1 May 23, 2024

Related U.S. Application Data

(60) Provisional application No. 63/384,769, filed on Nov. 22, 2022.

(51) Int. Cl.
*F23D 14/02* (2006.01)
*F23L 7/00* (2006.01)

(52) U.S. Cl.
CPC ..... *F23D 14/02* (2013.01); *F23L 7/00* (2013.01)

(58) Field of Classification Search
CPC ..... F23D 14/02; F23D 14/22; F23D 14/62; F23C 9/00; F23C 2202/10; F23L 7/00
See application file for complete search history.

(56) References Cited

U.S. PATENT DOCUMENTS

| | | | |
|---|---|---|---|
| 7,950,919 | B2 | 5/2011 | Johnson et al. |
| 2012/0024206 | A1 | 2/2012 | Varonen |
| 2016/0258630 | A1 | 9/2016 | Mitchell et al. |
| 2020/0018484 | A1 | 1/2020 | Rickey et al. |
| 2020/0386404 | A1 | 12/2020 | Kraus et al. |
| 2025/0383081 | A1* | 12/2025 | Richmond ..... F23D 14/64 |

FOREIGN PATENT DOCUMENTS

| | | | |
|---|---|---|---|
| CN | 111853784 | A | 10/2020 |
| CN | 213300081 | U | 5/2021 |
| CN | 114353083 | A | 4/2022 |

(Continued)

OTHER PUBLICATIONS

International Search Report from corresponding PCT application No. PCT/US2023/080520, mailed Mar. 18, 2024.

(Continued)

*Primary Examiner* — Alfred Basichas

(57) ABSTRACT

A burner configured to produce a flame in a combustion zone is provided where the burner includes a combustion air conduit that provides combustion air to the combustion zone, a targeted gas conduit surrounded by the combustion air conduit, the targeted gas provides a targeted gas, such as a NOx reducing medium, to the combustion zone and a fuel gas conduit surrounded by the targeted gas conduit, the fuel gas conduit provides fuel gas to the combustion zone, wherein a portion of the fuel gas is mixed with a portion of the targeted gas prior to mixing with the combustion air in the combustion zone.

15 Claims, 4 Drawing Sheets

(56) References Cited

FOREIGN PATENT DOCUMENTS

| | | | |
|---|---|---|---|
| JP | 2001193908 | A | 7/2001 |
| SU | 703731 | A1 | 12/1979 |
| WO | 9622424 | | 7/1996 |
| WO | 9957489 | A1 | 11/1999 |
| WO | 2016031540 | A1 | 3/2016 |

OTHER PUBLICATIONS

Written Opinion from corresponding PCT application No. PCT/US2023/080520, mailed Mar. 18, 2024.
United States Environmental Protection Agency, Technical Bulletin, Nitrogen Oxides (NOx), Why and How They Are Controlled, EPA 456/F-99-006R, Nov. 1999, (https://www3.epa.gov/ttncatc1/dir1/fnoxdoc.pdf).
De Ren, Jan et al., A paradigm shift in steam assisted elevated flare systems, Industrial Combustion, Journal of the International Flame Research Foundation, Article No. 201619, Jul. 2020, ISSN: 2075-3071.
Extended European Search Report from corresponding European application No. 23895326.9, dated Jul. 14, 2026. (8 pages).
International Search Report from corresponding PCT application No. PCT/US2026/021298, mailed Aug. 3, 2026.
Written Opinion from corresponding PCT application No. PCT/US2026/021298, mailed Aug. 3, 2026.

* cited by examiner

LOW NOx BURNER WITH TARGETED GAS INJECTION

RELATED APPLICATIONS

This application claims priority to U.S. Provisional Patent Application Ser. No. 63/384,769 filed on Nov. 22, 2022, the entirety of which is incorporated herein by reference.

FIELD OF THE INVENTION

This invention relates generally to a gas burner, and more particularly to a gas burner that utilizes a targeted gas, such as a NOx reducing medium, to lower NOx production.

BACKGROUND OF THE INVENTION

Petroleum refining and petrochemical processes frequently involve heating process streams in a furnace. The interior chamber of the furnace contains tubes which contain the process streams. The interior chamber is heated by a plurality of gas burners which receive a fuel which combusts to produce heat.

One area of concern for gas burners is the production of NOx gases. As would be appreciated, NOx refers to oxides of nitrogen, principally comprised of nitric oxide, NO, and nitric dioxide, $NO_2$. It is believed that there are at least three principal NOx formation mechanisms in combustion processes, namely, Thermal NOx, Fuel NOx, and Prompt NOx. See, "Nitrogen Oxides (NOx), What and How They are Controlled," EPA Technical Bulletin November 1999 (available at: https://www3.epa.gov/ttncatcl/dir1/fnoxdoc.pdf).

It is known that NOx formation in gas burners can be mitigated by staging fuel and air and creating primary and secondary combustion (flame) zones. Staged air and staged fuel burners work primarily on the Thermal NOx and Prompt NOx formation processes. The highest flame temperatures, and thereby the greatest potential for Thermal NOx formation, is achieved when gaseous fuels and combustion air are thoroughly mixed and rapidly combusted in or near stoichiometric proportions.

Accordingly, the staged air and staged fuel burners seek to lower the temperature of the flame and thereby lower the NOx production. Classic staged fuel or staged air burners produce two combustions zones for off-stoichiometric combustion.

In the case of the staged fuel burner, all the combustion air passes through the primary combustion zone and into the secondary combustion zone with the partial combustion products of the primary combustion zone. In this case, the primary combustion zone is lean, having an excess amount of combustion air. Lean combustion reduces the flame temperature, in part, as all of the mass of the combustion air rapidly absorbs and commutes heat from the flame out of the primary combustion zone and thus allowing time (measurable in milliseconds) for heat to radiate out of the primary combustion zone to the surrounding environs including to the heater, boiler or furnace process tubes. The fully and/or partially combusted (reacted) products of combustion pass from the primary combustion zone to the secondary or staged combustion zone. This transit allows time (again measurable in milliseconds) for the primary combustion zone products to further radiate heat out to the surrounding environs and process tubes. Therefore, the somewhat cooled combustion products from the primary combustion zone act to conduct heat from and cool the secondary combustion zone. Further, the secondary combustion zone combustion reactions occur, on average, at relatively lean conditions as the typical process heater, boiler or furnace operates at lean conditions with an excess of 5% to 25% combustion air. Thereby the combustion process is complete to a fair degree, industrially acceptable level of efficiency, 5% to 25% excess air.

The classic staged air burner reverses the staging process and introduces all the fuel gas for combustion in the primary combustion zone and only a portion of the combustion air. In the case of the staged air burner, the primary combustion zone may operate sub-stoichiometrically and achieve industrially acceptable excess air levels, 5% to 25% excess air, as reactants and products pass through the secondary combustion zone. With the staged air burner, the reactants must pass through a region of near stoichiometry where flame temperatures, and thereby Thermal NOx formation, is high and therefore staged air burners can have difficulty delivering very low NOx emissions.

More recently, internal flue gas recirculation burners have utilized flue gas within the heater or furnace combustion chamber which is motivated by the fuel gas and mixed into the primary and secondary combustion zones. This flue gas, relatively cool, massive products of combustion (flue gas), pass into and through the combustion zones thereby further cooling the combustion zone and reducing Thermal NOx formation. The water vapor in the flue gas also serves to mitigate NOx created via the Prompt NOx mechanism by solvating and catalyzing hydrocarbon combustion by more recently understood Water Gas Shift Reaction ("WGSR") mechanisms described in "A Paradigm Shift in Steam Assisted Elevated Flare Systems," International Flame Research Foundation, July 2020, by Jan De Ren, Kurt Kraus and Chris Ferguson. These WGSR mechanisms are also present to a limited degree in classic or conventional staged fuel or staged air burners as products of combustion from the primary combustion zone to the secondary combustion zone includes some water vapor.

In some combustion systems, a Selective Catalytic Reduction (SCR) system is used for post-flue gas treatment to NOx emissions. A SCR system is an effective way of reducing NOx in a flue gas stream, with reductions up to 95%. However, such systems require space for the catalyst and structure, high capital and operating costs, formation of other undesirable emissions, and formation of undesirable species that may lead to catalyst poisoning and deactivation.

Both staged air and staged fuel burners can require and produce large, voluminous flames to achieve low NOx emissions. Modern heater and furnace designs must be designed for larger, more costly combustion chambers to allow for larger low NOx emission burner flames of staged fuel and staged air burners.

Therefore, there remains a need for a burner that has low NOx production that does not suffer from these drawbacks.

SUMMARY OF THE INVENTION

A new burner and method of using same has been invented and utilizes targeted gas, namely a NOx reducing medium or mixture of NOx reducing media, to reduce NOx emissions generated during combustion in the burner. Specifically, the burner is configured so that the targeted gas and/or an internally recirculated flue gas flow between combustion air and fuel gas supplied to the combustion zone of the burner, which causes the targeted gas and/or the internally recirculated flue gas to mix with the fuel gas prior to subsequently mixing with the combustion air in the combustion zone. In this way, the "inert" components of the gas and/or NOx reducing media ($CO_2$, $N_2$, $H_2O$) are mixed in with the fuel gas to promote conductive heat transfer from the combustion reactants (fuel and air) from the onset of combustion and throughout the combustion reactants to reduce the incident or peak flame temperature in the combustion process. Reducing the peak flame temperature reduces oxidation of nitrogen in the combustion air or fuel gas in the reaction zone (flame) and thereby reduces the formation of thermal NOx, which is the NOx formed during combustion of fuel gas. Also, the water vapor from the gas (NOx reducing medium) serves to solvate and catalyze the combustion reaction to reduce the activation temperature of the combustion reactants to further reduce the peak flame temperature and thereby NOx emissions.

Thus, the present invention may be broadly characterized as providing a burner configured to produce a flame in a combustion zone, where the burner includes a combustion air conduit that provides combustion air to the combustion zone, a targeted gas conduit surrounded by the combustion air conduit, the targeted gas provides a gas, and more specifically, a NOx reducing medium, to the combustion zone and a fuel gas conduit surrounded by the targeted gas conduit, the fuel gas conduit provides fuel gas to the combustion zone, wherein a portion of the fuel gas is mixed with a portion of the targeted gas prior to mixing with the combustion air in the combustion zone.

In other embodiments, the fuel gas conduit includes an inlet that draws in additional flue gas from a combustion source. Also, the combustion air conduit may have a closed end and openings at the closed end, where the targeted gas (NOx reducing medium) flows across the closed end forming a fluid barrier between the combustion air and the fuel gas. Further, the targeted gas conduit may include a closed end and openings at the closed end for injecting the targeted gas into the combustion zone. Similarly, the fuel gas conduit may include a closed end and openings at the closed end for injecting the fuel gas into the combustion zone. In an embodiment, a portion of the fuel gas is injected through an inlet to the combustion air conduit and mixes with a portion of the combustion air prior to the combustion zone. In another embodiment, a portion of the targeted gas is mixed with a portion of the combustion air prior to entering the combustion air conduit with a balance of the targeted gas entering the targeted gas conduit. In a further embodiment, an amount greater than 0% to an amount equal to 95% of the targeted gas is mixed with the combustion air prior to entering the combustion air conduit with a balance of the targeted gas entering the targeted gas conduit. In an embodiment, the combustion air in the combustion air conduit is preheated to a predetermined temperature. Further in an embodiment, the combustion air in the combustion air conduit includes oxygen enriched or pure oxygen. The burner may also include a controller configured for controlling a flow rate of the combustion air in the combustion air conduit, a flow rate of the gas (NOx reducing medium) in the targeted gas conduit in a predefined proportion and flow rate of the fuel gas in the fuel gas conduit. In an embodiment, at least one aperture extends between the combustion air conduit and the targeted gas conduit. In another embodiment, at least one aperture extends between the targeted gas conduit and the fuel gas conduit.

In another aspect, the present invention may be characterized as providing a process for reducing production of NOx gases at a burner, where the process includes injecting a combustion air into a combustion zone, injecting a targeted gas into the combustion zone and injecting a fuel gas into the combustion zone, wherein a portion of the fuel gas is mixed with a portion of the targeted gas prior to mixing with the combustion air in the combustion zone.

In a further aspect, the present invention may be characterized as a process for controlling a burner using a control system to reduce the production of NOx gases during combustion, where the process comprises initiating a purge sequence in which at least one blower in the burner is automatically activated and supplies combustion air to the burner and recirculation lines, and closing inlet and outlet valves to the blower and recirculation lines to prevent combustible gases from accumulating in the burner and opening the inlet and outlet valves to the blower and recirculation lines when the purge sequence is complete. In an embodiment, the completion of the purge sequence includes changing at least four complete volumes of air in the burner. In another embodiment, the process further comprises electrically interlocking activating the burner until the purge sequence is complete. In another embodiment, the process further comprises controlling the at least one motor the blower, which is a variable frequency drive motor.

In another aspect, the present invention is characterized as a process for controlling a burner using a control system to reduce the production of NOx gases during combustion, where the process comprises operating the burner in standby mode until the temperature of a combustion chamber in the burner is at a predetermined minimum temperature, and operating the burner in run mode when the temperature of the combustion chamber of the burner is at the predetermined minimum temperature.

In another aspect, the present invention is characterized as a process for controlling a burner using a control system to reduce the production of NOx gases during combustion, where the process comprises directly injecting a NOx reducing medium in a combustion chamber in the burner and proportionately controlling the injection of the NOx reducing medium in the combustion chamber with a composition of a flue gas in the combustion chamber and a direct measurement of NOx emissions at an outlet of the burner. In an embodiment, the process includes controlling an injection rate of the NOx reducing medium in the combustion chamber by varying a speed of a blower in the burner using a variable frequency drive motor.

In a further aspect, the present invention is characterized as a process for controlling a burner in a burner system using a control system to reduce the production of NOx gases during combustion, where the process comprises directly injecting a NOx reducing medium in a combustion chamber in the burner and proportionately controlling the injection of the NOx reducing medium in the combustion chamber with at least one of an amount of NOx at an outlet of the burner, a temperature at the outlet of the burner, an amount of oxygen in the flue gas, a flow rate and pressure of a flue gas in the combustion chamber and a composition of the flue gas in the combustion chamber. In an embodiment, the process further comprises controlling an injection rate of the NOx reducing medium in the combustion chamber by varying a speed of a blower in the burner system using a variable frequency drive motor. In another embodiment, the process includes controlling an injection rate of the NOx reducing medium in the combustion chamber by varying the position of a flow control valve in the burner system by modulating a controller.

Additional aspects, embodiments, and details of the invention, all of which may be combinable in any manner, are set forth in the following detailed description of the invention.

DETAILED DESCRIPTION OF THE DRAWINGS

One or more exemplary embodiments of the present invention will be described below in conjunction with the following drawing figures, in which.

DETAILED DESCRIPTION OF THE INVENTION

As described above, the present invention addresses the problem of producing low NOx emissions in high temperature furnace and heater systems, especially when firing high hydrogen content fuel gasses and fuel gas that fluctuate from high hydrogen to low hydrogen content. Specifically, the present burner utilizes a targeted NOx reducing medium such as N2, CO2, H2O, a recirculated flue gas or any suitable combination of these gases, to reduce NOx emissions low enough to eliminate the need for Selective Catalytic Reduction SCR systems thereby reducing capital and operating expenses and the carbon footprint of high temperature furnace and heater systems during both installation and long-term operation. With these general principles in mind, one or more embodiments of the present invention will be described with the understanding that the following description is not intended to be limiting.

Figure 1A:
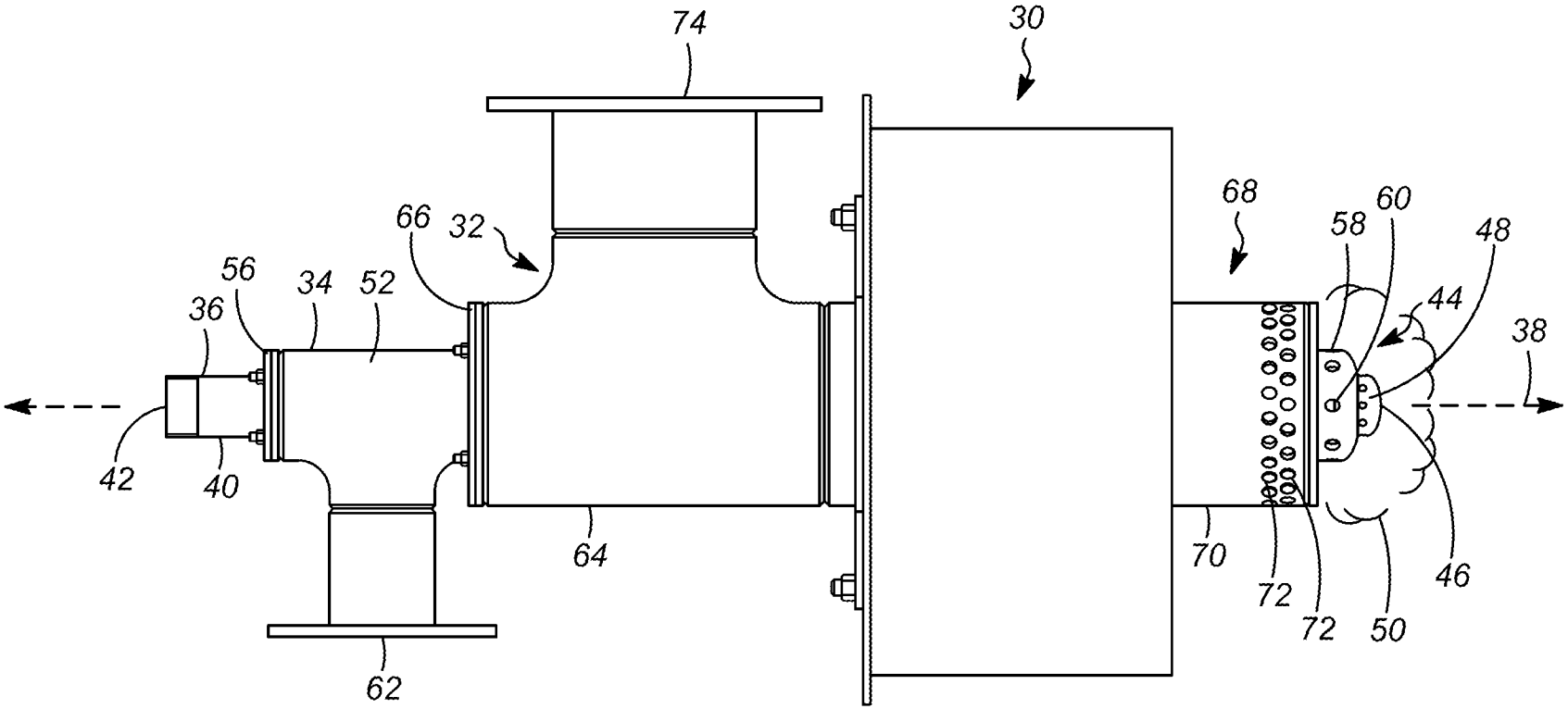
FIG. 1A is a perspective view of a burner according to the present invention.
Figure 1B:
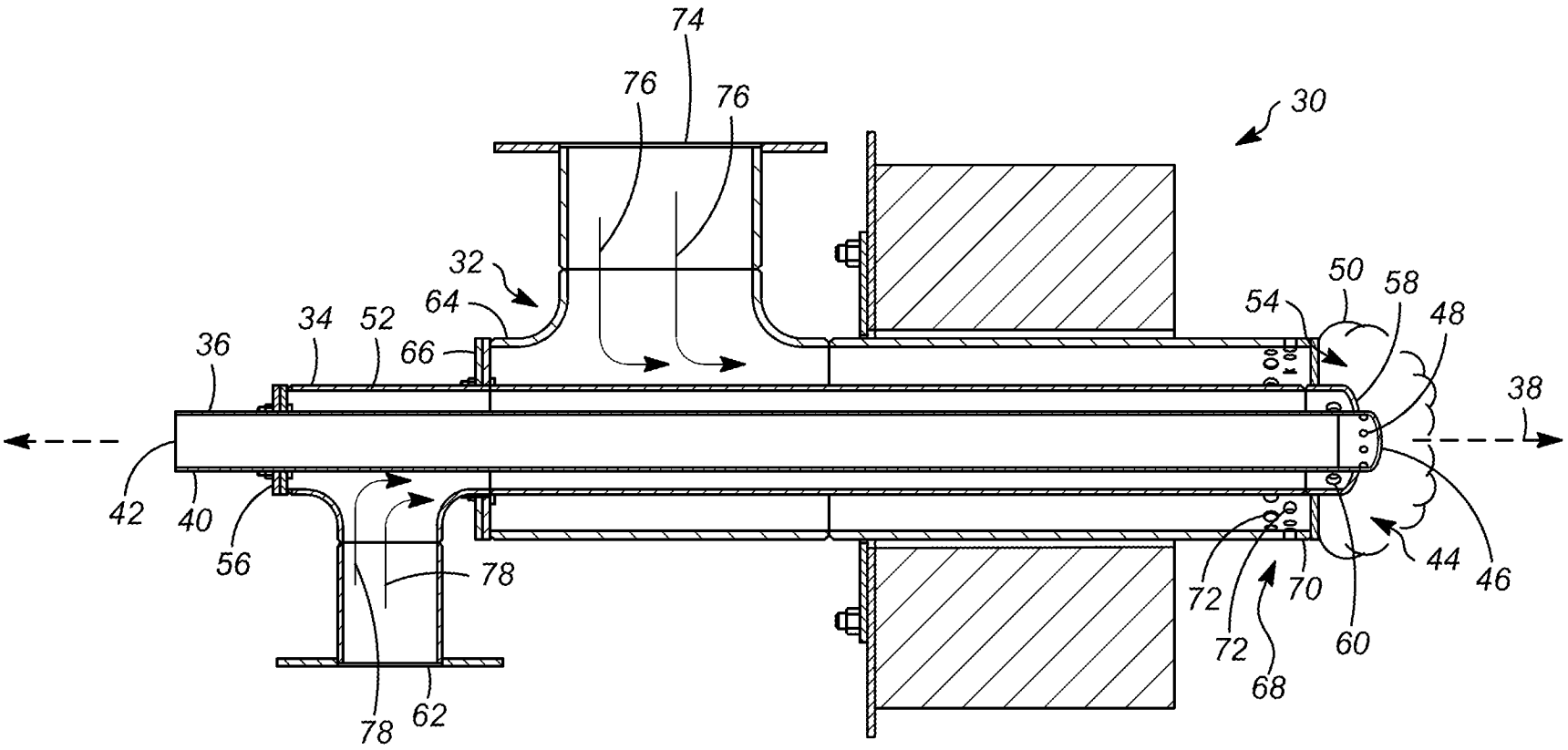
FIG. 1B is a cross-sectional view of a burner shown in FIG. 1A.

As shown in the FIGS. 1A and 1B, the present burner generally indicated as 30, includes a combination of a combustion air conduit 32, a targeted gas conduit 34 and a fuel gas conduit 36.

The fuel gas conduit 36 is centrally located within the burner 30 and has a longitudinal axis 38 and a first diameter. A first end 40 of the fuel gas conduit 36 includes an inlet 42 for receiving fuel gas and an opposing second end 44 is closed by a cap 46. The cap 46 may be independently formed and attached to the fuel gas conduit 36 by welding or other suitable attachment method or integrally formed with the fuel gas conduit. As shown, at least one gas opening, and preferably, a plurality of spaced gas openings 48 extend or are formed along a circumference of the fuel gas conduit 36 at the second end 44 to inject the fuel gas into a primary combustion zone 50 within a combustion chamber (not shown) that may be a stack or furnace. Contemplated sources and/or compositions of the fuel gas include refinery fuel gas, synthetic fuel gas, process off gas, natural gas, propane, butane, LPG, hydrogen including up to 100% by volume, and any combination of the foregoing. The pressure of the fuel gas may vary from 0.07 to 2.07 Barg (1 to 30 psig).

The targeted gas conduit 34 has a second diameter and extends along the longitudinal axis 38, where the second diameter of the targeted gas conduit 34 is greater than the first diameter of the fuel gas conduit 36 such that the targeted gas conduit surrounds the fuel gas conduit. A first end 52 and an opposing second end 54 of the targeted gas conduit 34 are both closed. Specifically, the first end 52 of the targeted gas conduit 34 includes a flange 56 that is secured to the conduit 34 by fasteners. The second end 54 includes a cap 58 similar to the cap 46 of the fuel gas conduit 36 and has at least one gas opening, and preferably a plurality of spaced gas openings 60 extending along a circumference of the targeted gas conduit 34 at the second end 54. As shown in FIGS. 1A and 1B, the gas openings 60 are spaced from the fuel gas openings 48 and inject targeted gas (NOx reducing medium) into the combustion zone 50. The targeted gas conduit 34 includes an inlet 62 at the first end 52 that is transverse to the longitudinal axis 38 and supplies the targeted gas and/or a NOx reducing medium, to the targeted gas conduit 34 from a gas source, such as a source of a NOx reducing medium.

The combustion air conduit 32 has a third diameter and extends along the longitudinal axis 38, where the third diameter of the combustion air conduit 32 is greater than the second diameter of the targeted gas conduit 34 and the first diameter of the fuel gas conduit 36 such that the combustion air conduit 32 surrounds the targeted gas conduit 34 and the fuel gas conduit 36. Similar to the targeted gas conduit, the combustion air conduit 32 includes a first end 64 that is closed by a flange 66 secured to the conduit by fasteners, and an opposing second end 68 that is closed by a cap 70 that is independently formed and secured to the conduit 32 by welding or other suitable attachment method, or integrally formed with the conduit. The combustion air conduit 32 also includes at least one air opening, and preferably a plurality of spaced air openings 72 at the second end 68, where the air openings 72 extend about a circumference of the conduit 32 and are spaced from the fuel gas openings 48 and the gas openings 60. In the illustrated embodiment, the combustion air conduit includes two rows of the air openings. It is contemplated that the combustion air conduit 32 may have a single row or a plurality of rows of the air openings 72. Further, the combustion air conduit 32 includes an inlet 74 at the first end 64 of the conduit that is transverse to the longitudinal axis 38 and receives air, also called combustion air, where the air flows along the combustion air conduit 32 as shown by arrows 76 and injects the combustion air into the combustion zone 50 through the air openings 72.

In operation, the targeted gas conduit 34 of the present burner 30 receives targeted gas, such as a NOx reducing medium or a mixture of NOx reducing media, through the inlet 62 such that the targeted gas flows along the outer surface of the fuel gas conduit 36 as indicated by arrows 78, such that the targeted gas (NOx reducing medium) is positioned between the combustion air and the fuel gas to effectively create a barrier between the combustion air and the fuel gas thereby enabling the targeted gas to mix with the fuel gas prior to mixing with the combustion air in the combustion zone 50. Also, the fuel gas is injected at a location where it also draws in a flue gas from a combustion source, such as a surrounding furnace (not shown). Thus, as shown in FIGS. 1A and 1B, at least a portion of the targeted gas and at least a portion of the fuel gas mix together prior to mixing with at least a portion of the combustion air in the combustion zone. The present burner 30 thereby effectively surrounds the fuel gas with both an internally recirculated flue gas and/or an externally recirculated and targeted gas (NOx reducing medium), forcing mixing of the internal flue gas and the targeted gas with the fuel gas prior to subsequently mixing with the combustion air. In this way, the "inert" components of the targeted gas and/or a NOx reducing medium, such as CO2, N2, H2O, are physically mixed in with the fuel gas to promote conductive heat transfer from the combustion reactants (fuel and air) from the very onset of combustion and throughout combustion reactions thereby having a maximum effect to reduce the incident or peak flame temperature throughout the combustion process in the combustion zone 50. Reducing the peak flame temperature reduces oxidation of nitrogen entering the combustion zone (flame) from the combustion air or fuel thereby reducing thermal NOx formation.

Further, water vapor from the NOx reducing medium, or steam injected as a NOx reducing medium, serves to solvate and catalyze the combustion reaction thereby reducing the activation temperature of the combustion reactants and thereby the resulting incident and peak flame temperatures in the combustion zone, which further reduces NOx emissions.

By producing NOx emissions that are low enough (often lower that 5 to 20 ppmvd) to eliminate the need for SCRs or other similar NOx reducing equipment, the capital and operating expenses required to achieve regulatory NOx emissions is greatly reduced. For example, burners with the present Targeted Flue Gas Recirculation system (TFGR system) can reduce total installation costs by over 50% to 90%. Additionally, the amount of steel, refractory materials and other materials needed for construction in a burner installation on a new burner system or retrofit system is, of course, greatly reduced, as well as the carbon footprint. Additional NOx reducing systems that utilize a catalyst, a catalyst bed, a housing, an ammonia injections system, ammonia supply trucking, receiving, tank storage and delivery system are all replaced with the present burner 30 and TFGR system.

Figure 2:
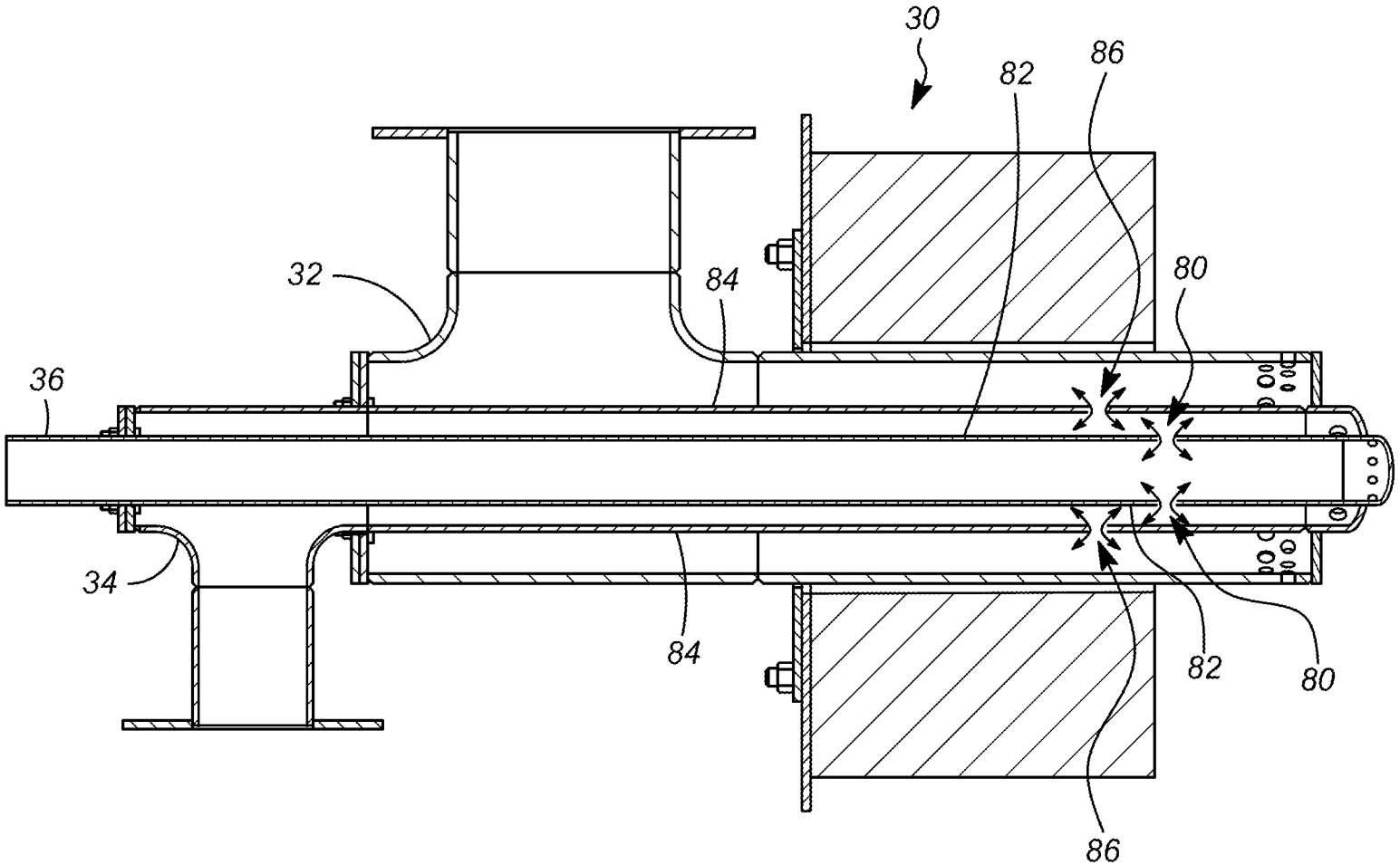
FIG. 2 is cross-sectional view of another embodiment of a burner according to the present invention.

Referring to FIG. 2, another embodiment of the burner 30 according to the present invention is shown in which the same reference numbers are used for the same features.

The burner 30 of FIG. 2 is configured with an opening, hole or aperture 80 in a wall 82 of the fuel gas conduit 36 between the fuel gas conduit and the targeted gas conduit 34. Also, the wall 84 of the targeted gas conduit 34 includes an opening, hole or aperture 86 between the targeted gas conduit 34 and the combustion air conduit 32. It is contemplated that the wall 82 of the fuel gas conduit 36 and the wall 84 of the targeted gas conduit 34 may include a single opening, hole or aperture, or a plurality of openings, holes or apertures 80, 86. Further, the openings 80, 86 may be in the walls 82, 84 of both the fuel gas conduit 36 and the targeted gas conduit 34 as shown in FIG. 2, or only in the wall 82 of the fuel gas conduit 36 or the wall 84 of the targeted gas conduit 34.

In any of the configurations described in this embodiment, if the targeted gas (NOx reducing medium) in the targeted gas conduit 34 is supplied at a pressure higher than that of the combustion air or the fuel gas, then a portion of the targeted gas (or other NOx reducing media) will enter and mix with the combustion air and/or the fuel gas, thereby premixing with the combustion air and/or fuel gas before ejection from the burner combustion in the combustion zone 50, which further enhances NOx reducing mechanisms resulting in low NOx emissions from combustion. This premixing may also enhance burner flame stability delivering continuously stable combustion.

Additionally, if the combustion air pressure or the fuel gas pressure is greater than that of the pressure of the targeted gas, then fuel gas or combustion air can flow into the targeted gas (or NOx reducing media), thereby premixing with the targeted gas prior to ejecting out the burner 30 in the combustion zone 50 for similar NOx reducing effects and/or flame stabilization in the combustion zone 50.

As noted above, it has been discovered that further control of the NOx production may be achieved by providing a NOx reducing medium via the targeted gas conduit 34. The NOx reducing media may include, but are not limited to, fluids such as flue gas from the combustion zone 50, flue gas from the exhaust of a heater, boiler or furnace surrounding or associated with the present burner 30, steam (water vapor), nitrogen, carbon dioxide or even a fuel gas such as methane. It is known that inert gases such as water vapor, nitrogen and carbon dioxide injected in the fuel gas or air stream of a burner can help reduce NOx emissions by reducing the partial pressure of reactants, both fuel and air, cooling and by transferring heat out of the combustion section of the combustion zone 50. Further, water vapor and a gas (NOx reducing medium) containing water vapor facilitate catalyzing and solvating the combustion reactions. Accordingly, in some of the various configurations of the present invention, a portion or all the NOx reducing medium (or a mixture of NOx reducing media) is supplied to the targeted gas conduit 34 to facilitate selective and designed proportioning of the NOx reducing medium in the optimal location(s) in the flame zone(s) in the combustion zone 50.

While there may be many and various sources for the NOx reducing medium, one preferred source is the flue gas from the combustion zone 50 itself. External flue gas recirculation of flue gas is well known and practiced in the industry and involves the movement of flue gas from an exhaust chimney or stack of the burner to the inlet of the burner, usually by a powered fan. External flue gas recirculation is costly from both capital and operating cost perspectives. The convection sections of the heater, boiler, or furnace must be made larger to accommodate the addition of the recycled flue gas in the system, the ducting and fan must be purchased and installed, and the fan must be powered and operated. Further, relatively large quantities of external flue gas, around 30% of the flue gas volume, must be recycled to achieve significant NOx reduction when the flue gas is mixed with the combustion air.

It has also been discovered that flue gas from a fluidized catalytic cracking (FCC) unit is another source of the NOx reducing medium that may be used to reduce NOx production from a burner flame. An exemplary FCC unit is described in U.S. Pat. Pub. Nos. 2021/0009904 and 2020/0325087, both incorporated herein by reference. While the use of the FCC flue gas, alone, is believed to reduce the NOx production, if used in a burner with the present TFGR system, the production of NOx gases will be further reduced.

In the above embodiments, a control system including a controller or a control unit, which may be a processor, is used to control the operation of the burner 30 such that the control unit communicates with the burner and is designed to actively control the injection rates, locations, localized stoichiometry and NOx reducing medium introduced to the combustion process, the flame, the NOx production can be mitigated to extremely low values, less than 10 ppmvd with relatively modest amounts of NOx reducing media such as flue gas. Increasing rates of flue gas recirculation, while further reducing NOx emissions, can lead to burner instability and/or loss of flame. By designing for and actively controlling the injection rates, locations, localized stoichiometry and NOx reducing medium introduced to the combustion process, the flame and the NOx formation can be mitigated while maintaining good burner and flame stability and continuous operation.

Figure 3:
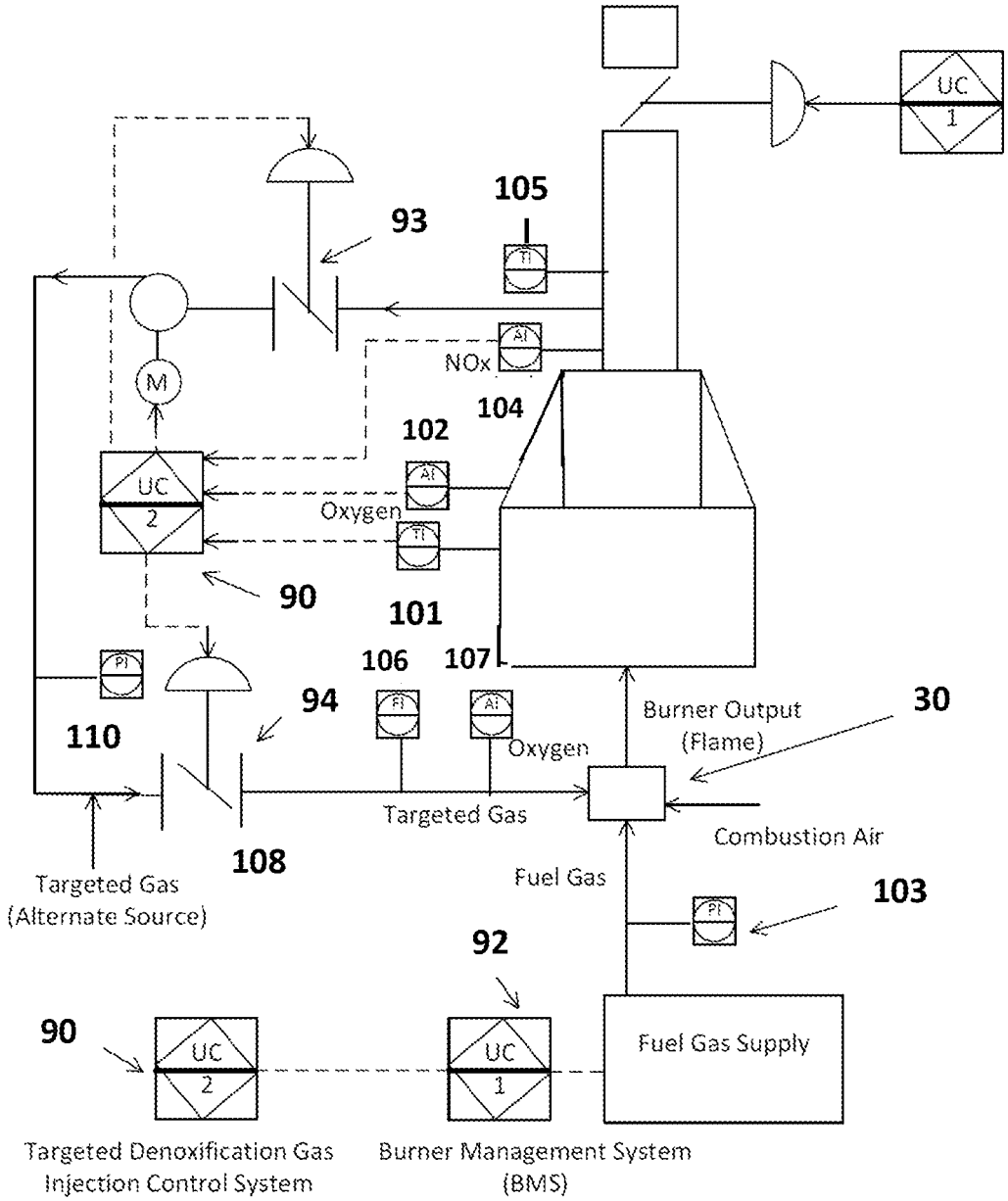
FIG. 3 is a schematic drawing of an embodiment of a control system associated with the burner in the embodiments shown in FIGS. 1A, 1B and 2.

An embodiment of the control system 90 in communication with burner 30 is shown in FIG. 3. More specifically, the control system 90 communicates with a burner control system associated with the burner and controls the operation of the burner. The control system 90 performs different control operations for the burner 30 including an open loop control operation, a partially closed loop control operation and a closed loop control operation.

The primary focus of the control system is to reduce thermal NOx emissions from the burner 30. The levels of excess air, the temperature of that air, and the way that the air is mixed with the gas affects the production of NOx during combustion. The control system communicates with and controls the burner 30 and a blower with isolation valves at inlet and outlet to the burner. In this way, the control system controls the injection of the targeted gas (NOx reducing medium) to significantly reduce NOx emissions generated during the combustion process.

The control system includes a control panel located in a control room at the facility including the burner 30 or at a remote site that is at a different facility or location from the burner, and communicates with the burner control system (burner) 92 with DCS via Modbus TCP/IP communications. During operation, the control system provides orderly and safe startup, operation, and shutdown of the burner. The design of the burner incorporates blowers, isolation valves, critical analyzer, and sensors to execute the start, stop and shutdown of the burner. All necessary permissive, sequence status and alarms related to the burner will be displayed on the HMI Installed on the control panel of the control system.

In an embodiment, the burner system includes a low NOx burner, a blower with a variable frequency drive (VFD), blower inlet 93 and outlet 94 isolation valves, three (3) mandatory instruments (i.e., firebox temperature sensor 101, firebox $O_2$ analyzer 102 and fuel gas pressure meter 103), optional instrumentation (i.e., stack NOx analyzer 104, stack temperature transmitter 105, a recirculation flow meter 106, an oxygen ($O_2$) meter 107 and a pressure meter 110, and a NOx control performance curve programmed in a dedicated Programable Logic Controller (PLC) (or other suitable computer controller). The unique design of the present burner system and control system uses a targeted NOx reducing medium to significantly reduce NOx emissions produced by burner 30.

The control system 90 performs different control operations associated with the burner 30, including but not limited to, a purge operation or purge sequence, an open loop control operation, a partially closed loop control operation and a closed loop control operation.

The purpose of the purge sequence is to remove the flammable vapors and gases that has entered any portion of the targeted gas burner system including the burner and ducting from the burner outlet such as a stack, during the shutdown of the burner. The purge time is set to ensure that at least four volume changes through the burner system have been completed.

In the purge operation/sequence, a purge assembly including blower inlet and outlet isolation valves and a recirculation purge assembly directly connect to the burner assembly, i.e., the burner 30. The purge sequence activates a purge cycle that is in concert with the burner control system, while being independent and not requiring any operator input or intervention. The inclusion of this features allows the burner system to operator fully automatically by maintaining safe operating conditions, even when not in use because of the isolation technique employed. Also, the unique purge sequence helps to remove the recirculated flue gas from recirculating ducting before initiating ignition of the burner 30.

The purge sequence starts by activating a 'Purge Start' switch. The operation of this switch initiates the purge sequence of a process heater, i.e., the burner 30. Upon completion, the blower speed is controlled by a variable frequency drive (VFD), i.e., VFD motor, and starts to ramp up to full speed to provide sufficient flow within the burner system to replace combustible gas in one or more recirculation lines with fresh air coming from the combustion air conduit 32.

Upon completion of the purge cycle, the blower, recirculation lines and inlet and/or outlet valves are closed, which prevents combustible gases from the stack from flowing into burner injection until a pilot flame and main burner flame are ignited. The main burner flame safeguard is electrically interlocked with the control system to provide proof that the purge of the ducting purge within the burner system has been successfully completed.

In a standby/run sequence, the control system 90 allows an operator to operate the targeted gas burner system in a safe standby mode or a run mode, where the mode depends on the plant requirements. One or more safety interlocks associated with the firebox/burner temperature, fuel gas pressure, process heater oxygen percentage ($O_2$%), flame failure and other process heater trip conditions, will hold the targeted gas burner system in the standby mode to prevent any thermal shock, undesired operation, and/or flame instability until the burner (process heater) combustion chamber is properly warmed up with minimum load.

During the run mode, a designated amount of the NOx reducing medium is directly injected to the burner and is controlled proportionately with three or more mandatory critical sensors, i.e., firebox/burner temperature, firebox/burner oxygen percentage, and analyzer and fuel gas pressure using secondary controllers in the targeted gas burner system. The injection rate is accomplished by varying the speed of blower in the targeted gas burner system by a variable frequency drive (VFD) control. The performance curve between the targeted gas burner system VFD speed versus the above-mentioned sensors are developed uniquely after actual performance tests of the burner. There may be different NOx reducing media, such as targeted NOx reduction gas 108, $CO_2$, Nitrogen and steam, which are controlled using a control valve with a flow control loop to reduce the NOx emissions.

Additionally in an alternate operation, the control system initiates a "Closed Loop" mode in which the NOx reducing medium is directly injected to the burner 30 and is controlled proportionately with a composition of the NOx reducing medium, which is measured using direct NOx measurement at the stack or using an indirect oxygen measurement. The injection rate is accomplished by varying the speed of burner system blower by VFD control.

In another alternate operation, the control system injects the NOx reducing medium directly to the burner 30, which is controlled proportionately with the NOx reducing medium, the temperature at the stack, the flow and pressure of the fuel gas and the fuel gas composition. The injection rate is accomplished by varying the speed of blower by VFD control. This mode of the control system functions to operate the controlled variables toward achieving the significantly low NOx emissions.

In the above embodiments, the targeted gas controllers are unique in a way that utilizes both "Open" and "Closed" control loops for injecting the NOx reducing medium into the burner to control NOx emissions. Specifically, the unique features and technical advantages to the control system over other flue gas or other, earlier, NOx reducing medium control systems are that the control system 90:

1. Integrates the purge sequence of the NOX reducing medium injection with the purge sequence of the burner and heater system for safe startup as outlined in various regulatory sources, such as for example, the NFPA® 85 Boiler and Combustion Systems Hazards Code.

2. Automatically shuts down and isolates the NOx reducing medium injection system after the pre-combustion purge sequence by shutting off any control or isolation valves and shutting off any fans, compressors or pumps for the NOx reducing medium and entering the targeted gas burner system Standby/Run sequence to await a call for service.
3. Closes and shuts off the targeted gas burner system when the firebox (combustion chamber) temperature of the burner is low at startup/initial igniting of the burner flame, and the oxygen in the combustion chamber is high (21% by volume) and the temperature is cold, i.e., close to ambient temperature. At these conditions, the NOx generation at ignition and immediately thereafter will be very low and there is no need or call for the NOx reducing medium.
4. As the burner firing rate increases from ignition levels to normal operation levels, the firebox temperature increases and approaches normal levels (700° ° C. to 1275° C.) depending on the service and type of heater or furnace) and the oxygen level decreases from ambient (21% by volume oxygen) to normal operation oxygen levels of between 1% and 5% by volume oxygen in the combustion chamber and the fuel pressure increases from turndown levels to normal operating levels. At some combination of elevated firebox temperature (over 760° C.) and fuel gas pressure (over 5 psig in some cases) and reduced oxygen level (less than maybe 5% by volume oxygen), the NOx formation will approach a regulatory limit. At a predetermined firebox temperature, oxygen and fuel pressure limits, the targeted gas burner system begins delivering the NOx reducing medium to the burner(s) and ramp up the injection rate to predetermined rates of injection thereby reducing NOx production in proportion during combustion.

The following are examples of how the targeted gas rate of injection is modulated in proportion to various inputs:

Increase target gas (NOx reducing medium) flow when fuel gas pressure increases

Increase target gas (NOx reducing medium) flow when firebox temperature increases Adjust target gas (NOx reducing medium) flow when oxygen decreases depending on other predetermined conditions which increases or decreases the flow to correct for abnormal oxygen condition;

Increase target gas (NOx reducing medium) flow when fuel composition changes, to a higher hydrogen content;

Increase target gas (NOx reducing medium) flow when NOx concentration is too high, until NOx emissions are met, i.e., closed-loop operation mode;

Bleed more fresh air into the targeted gas when the temperature of the targeted gas temperature is above a designated or predefined limit.

When oxygen concentration in the targeted gas (NOx reducing medium) changes, such as low oxygen concentration, then less of the targeted gas is needed, and if high oxygen concentration, then more of the targeted gas is needed to achieve NOx emissions reduction goal;

When flow of targeted gas is measured directly, the flow can be used in closed loop control to maintain consistently low NOx emissions using direct control of the stack NOx condition Pressure of the targeted gas (NOx reducing medium) can be a surrogate of a flow meter in the targeted gas or indicative of the amount of flow for loop control of targeted gas to maintain consistently low NOx emissions.

While the lowest NOx emissions may be produced when the burner 30 receives the highest flowrates of the NOx reducing medium, this may also be the incipient point of burner instability. This incipient instability can be detected by a high-speed pressure transmitter and associated instability detection software similar to that described in U.S. Pat. No. 7,950,919. However, unlike U.S. Pat. No. 7,950,919 where principally combustion chamber oxygen is controlled and adjusted to react to instability, in this invention, the rate and location of NOx reducing medium can be controlled.

Generally, the NOx emissions from the burner 30 may be monitored using sensors, such as flow rate and/or temperature sensors, mounted at different locations within the heater, along with the stack oxygen and the combustion chamber pressure or draft. The rate, the amount of NOx reducing medium delivered, or both may be increased at the desired locations in the flame zone until the required NOx reduction is achieved. Once the desired NOx level is achieved no additional NOx reducing medium may be introduced. If the burner becomes unstable, the rate and/or location of the NOx reducing medium can be controlled or the excess air, oxygen levels adjusted as suggested in U.S. Pat. No. 7,950,919 until burner stability is achieved.

It is further contemplated that visual field or infrared cameras may be used to monitor flame stability and quality aspects using artificial intelligence, AI, such as described in U.S. Patent Publ. No. 2020/0386404 (incorporated herein by reference). When instabilities or other anomalies in the flame image are detected with the AI, the amount and location of the NOx reducing medium and/or other control aspects of the heater controls system, such as excess oxygen, can be adjusted and controlled to simultaneously deliver the lowest level of NOx (or at least the required level) with good burner flame stability.

If there is a loss of NOx reducing medium at any time or at any moment, the present burner 30 will still work safely as a conventional low NOx burner. The NOx emissions may increase, but the burner 30 will otherwise remain stable and continue to deliver heat reliably to the process in the heater, boiler or furnace. Further, the burner 30 will operate, in the view of the burner operator, just as conventional burners operate with no special operational issues.

It should be appreciated and understood by those of ordinary skill in the art that various other components such as valves, pumps, fans, filters, coolers, etc. are not shown in the drawings as it is believed that the specifics of same are well within the knowledge of those of ordinary skill in the art and a description of same is not necessary for practicing or understanding the embodiments of the present invention.

Any of the above lines, conduits, units, devices, vessels, surrounding environments, zones or similar may be equipped with one or more monitoring components including sensors, measurement devices, data capture devices or data transmission devices. Signals, process or status measurements, and data from monitoring components may be used to monitor conditions in, around, and on process equipment. Signals, measurements, and/or data generated or recorded by monitoring components may be collected, processed, and/or transmitted through one or more networks or connections that may be private or public, general or specific, direct or indirect, wired or wireless, encrypted or not encrypted, and/or combination(s) thereof; the specification is not intended to be limiting in this respect.

Signals, measurements, and/or data generated or recorded by monitoring components may be transmitted to one or more computing devices or systems. Computing devices or systems may include at least one processor and memory storing computer-readable instructions that, when executed by the at least one processor, cause the one or more computing devices to perform a process that may include one or more steps. For example, the one or more computing devices may be configured to receive, from one or more monitoring component, data related to at least one piece of equipment associated with the process. The one or more computing devices or systems may be configured to analyze the data. Based on analyzing the data, the one or more computing devices or systems may be configured to determine one or more recommended adjustments to one or more parameters of one or more processes described herein. The one or more computing devices or systems may be configured to transmit encrypted or unencrypted data that includes the one or more recommended adjustments to the one or more parameters of the one or more processes described herein.

The computing device of system unit may comprise, for example, any type of general-purpose microprocessor or microcontroller, a digital signal processing (DSP) processor, a central processing unit (CPU), an integrated circuit, a field programmable gate array (FPGA), a reconfigurable processor, other suitably programmed or programmable logic circuits, or any combination thereof.

The memory may be any suitable known or other machine-readable storage medium. The memory may comprise non-transitory computer readable storage medium such as, for example, but not limited to, an electronic, magnetic, optical, electromagnetic, infrared, or semiconductor system, apparatus, or device, or any suitable combination of the foregoing. The memory may include a suitable combination of any type of computer memory that is located either internally or externally to the device such as, for example, random-access memory (RAM), read-only memory (ROM), compact disc read-only memory (CDROM), electro-optical memory, magneto-optical memory, erasable programmable read-only memory (EPROM), and electrically-erasable programmable read-only memory (EEPROM), Ferroelectric RAM (FRAM) or the like. The memory may comprise any storage means (e.g., devices) suitable for retrievably storing the computer-executable instructions executable by the controller or a computing device.

The methods and steps described herein may be implemented in a high-level procedural or object-oriented programming or scripting language, or a combination thereof, to communicate with or assist in the operation of the controller or computing device. Alternatively, the methods and systems described herein may be implemented in assembly or machine language. The language may be a compiled or interpreted language. Program code for implementing the methods and systems for control gas flow to a burner described herein may be stored on the storage media or the device, for example a ROM, a magnetic disk, an optical disc, a flash drive, or any other suitable storage media or device. The program code may be readable by a general or special-purpose programmable computer for configuring and operating the computer when the storage media or device is read by the computer to perform the procedures described herein.

Computer-executable instructions may be in many forms, including program modules, executed by one or more computers or other devices. Generally, program modules include routines, programs, objects, components, data structures, etc., that perform particular tasks or implement particular abstract data types. Typically, the functionality of the program modules may be combined or distributed as desired in various embodiments.

Specific Embodiments

While the following is described in conjunction with specific embodiments, it will be understood that this description is intended to illustrate and not limit the scope of the preceding description and the appended claims.

A first embodiment of the invention is a burner configured to produce a flame in a combustion zone, the burner comprising a combustion air conduit that provides combustion air to the combustion zone; a targeted gas conduit surrounded by the combustion air conduit, the targeted gas provides a targeted gas to the combustion zone; a fuel gas conduit surrounded by the targeted gas conduit, the fuel gas conduit provides fuel gas to the combustion zone, wherein a portion of the fuel gas is mixed with a portion of the targeted gas prior to mixing with the combustion air in the combustion zone. An embodiment of the invention is one, any or all of prior embodiments in this paragraph up through the first embodiment in this paragraph, wherein an inlet of the fuel gas conduit draws in a flue gas from a combustion source. An embodiment of the invention is one, any or all of prior embodiments in this paragraph up through the first embodiment in this paragraph, wherein the combustion air conduit includes a closed end and openings at the closed end, the targeted gas flows across the closed end forming a fluid barrier between the combustion air and the fuel gas. An embodiment of the invention is one, any or all of prior embodiments in this paragraph up through the first embodiment in this paragraph, wherein the targeted gas conduit includes a closed end and openings at the closed end. An embodiment of the invention is one, any or all of prior embodiments in this paragraph up through the first embodiment in this paragraph, wherein the fuel gas conduit includes a closed end and openings at the closed end. An embodiment of the invention is one, any or all of prior embodiments in this paragraph up through the first embodiment in this paragraph, wherein a portion of the fuel gas is injected through an inlet to the combustion air conduit and mixes with a portion of the combustion air prior to the combustion zone. An embodiment of the invention is one, any or all of prior embodiments in this paragraph up through the first embodiment in this paragraph, wherein a portion of the targeted gas is mixed with a portion of the combustion air prior to entering the combustion air conduit with a balance of the targeted gas entering the targeted gas conduit. An embodiment of the invention is one, any or all of prior embodiments in this paragraph up through the first embodiment in this paragraph, wherein an amount greater than 0% to an amount equal to 95% of the targeted gas is mixed with the combustion air prior to entering the combustion air conduit with a balance of the targeted gas entering the targeted gas conduit. An embodiment of the invention is one, any or all of prior embodiments in this paragraph up through the first embodiment in this paragraph, further comprising at least one aperture extending between the combustion air conduit and the targeted gas conduit. An embodiment of the invention is one, any or all of prior embodiments in this paragraph up through the first embodiment in this paragraph, further comprising at least one aperture extending between the targeted gas conduit and the fuel gas conduit. An embodiment of the invention is one, any or all of prior embodiments in this paragraph up through the first embodiment in this paragraph, further comprising at least one aperture extending between the targeted gas conduit and the fuel gas conduit. An embodiment of the invention is one, any or all of prior embodiments in this paragraph up through the first embodiment in this paragraph, wherein the targeted gas is a NOx reducing medium or a mixture of NOx reducing media.

A second embodiment of the invention is a process for reducing production of NOx gases at a burner, the process comprising injecting a combustion air into a combustion zone; injecting a targeted gas into the combustion zone; and injecting a fuel gas into the combustion zone, wherein a portion of the fuel gas is mixed with a portion of the targeted gas prior to mixing with the combustion air in the combustion zone. An embodiment of the invention is one, any or all of prior embodiments in this paragraph up through the second embodiment in this paragraph, further comprising mixing a portion of the fuel gas with the combustion air prior to the combustion zone. An embodiment of the invention is one, any or all of prior embodiments in this paragraph up through the second embodiment in this paragraph, further comprising mixing a portion of the targeted gas with the combustion air. An embodiment of the invention is one, any or all of prior embodiments in this paragraph up through the second embodiment in this paragraph, further comprising mixing an amount of the targeted gas greater than 0% to an amount of 95% with the combustion air. An embodiment of the invention is one, any or all of prior embodiments in this paragraph up through the second embodiment in this paragraph, wherein the targeted gas is a NOx reducing medium or a mixture of NOx reducing media.

A third embodiment of the invention is a process for controlling a burner using a control system to reduce the production of NOx gases during combustion, the process comprising initiating a purge sequence in which at least one blower in the burner is automatically activated and supplies combustion air to the burner and recirculation lines; closing inlet and outlet valves to the blower and recirculation lines to prevent combustible gases from accumulating in the burner; and opening the inlet and outlet valves to the blower and recirculation lines when the purge sequence is complete. An embodiment of the invention is one, any or all of prior embodiments in this paragraph up through the third embodiment in this paragraph, wherein completing the purge sequence includes changing at least four complete volumes of air in the burner. An embodiment of the invention is one, any or all of prior embodiments in this paragraph up through the third embodiment in this paragraph, further comprising electrically interlocking activating the burner until the purge sequence is complete.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

What is claimed is:

1. A burner configured to produce a flame in a combustion zone, the burner comprising:

a combustion air conduit that provides combustion air to the combustion zone;

a targeted gas conduit surrounded by said combustion air conduit, said targeted gas provides a targeted gas to the combustion zone;

a fuel gas conduit surrounded by said targeted gas conduit, said fuel gas conduit provides fuel gas to the combustion zone, wherein a portion of the fuel gas is mixed with a portion of the targeted gas prior to mixing with the combustion air in the combustion zone, and an inlet in said combustion air conduit, wherein another portion of the fuel gas is injected through said inlet to said combustion air conduit and mixes with a portion of the combustion air prior to the combustion zone.

2. The burner of claim 1, wherein an inlet of said fuel gas conduit draws in a flue gas from a combustion source.

3. The burner of claim 1, wherein said combustion air conduit includes a closed end and openings at said closed end, the targeted gas flows across said closed end forming a fluid barrier between the combustion air and the fuel gas.

4. The burner of claim 1, wherein said targeted gas conduit includes a closed end and openings at said closed end.

5. The burner of claim 1, wherein said fuel gas conduit includes a closed end and openings at said closed end.

6. The burner of claim 1, wherein a portion of the targeted gas is mixed with a portion of the combustion air prior to entering said combustion air conduit with a balance of the targeted gas entering said targeted gas conduit.

7. The burner of claim 6, wherein an amount greater than 0% to an amount equal to 95% of the targeted gas is mixed with the combustion air prior to entering said combustion air conduit with a balance of the targeted gas entering said targeted gas conduit.

8. The burner of claim 1, further comprising at least one aperture extending between said combustion air conduit and said targeted gas conduit.

9. The burner of claim 8, further comprising at least one aperture extending between said targeted gas conduit and said fuel gas conduit.

10. The burner of claim 1, further comprising at least one aperture extending between said targeted gas conduit and said fuel gas conduit.

11. The burner of claim 1, wherein said targeted gas is a NOx reducing medium or a mixture of NOx reducing media.

12. A process for reducing production of NOx gases at a burner, the process comprising:

injecting a combustion air into a combustion zone;

injecting a targeted gas into the combustion zone;

injecting a fuel gas into the combustion zone, wherein a portion of the fuel gas is mixed with a portion of the targeted gas prior to mixing with the combustion air in the combustion zone; and mixing another portion of the fuel gas with the combustion air prior to the combustion zone.

13. The process of claim 12, further comprising mixing a portion of the targeted gas with the combustion air.

14. The process of claim 12, further comprising mixing an amount of the targeted gas greater than 0% to an amount of 95% with the combustion air.

15. The process of claim 12, wherein the targeted gas is a NOx reducing medium or a mixture of NOx reducing media.

* * * * *